US011471007B2

(12) United States Patent
Kim et al.

(10) Patent No.: US 11,471,007 B2
(45) Date of Patent: Oct. 18, 2022

(54) CLEANSING DEVICE

(71) Applicant: LG HOUSEHOLD & HEALTH CARE LTD., Seoul (KR)

(72) Inventors: Mina Kim, Daejeon (KR); Taek Jong Kwak, Daejeon (KR); Sanghwa Lee, Daejeon (KR)

(73) Assignee: LG HOUSEHOLD & HEALTH CARE LTD., Seoul (KR)

( * ) Notice: Subject to any disclaimer, the term of this patent is extended or adjusted under 35 U.S.C. 154(b) by 97 days.

(21) Appl. No.: 16/971,221

(22) PCT Filed: May 3, 2018

(86) PCT No.: PCT/KR2018/005152

§ 371 (c)(1),
(2) Date: Aug. 19, 2020

(87) PCT Pub. No.: WO2019/212075

PCT Pub. Date: Nov. 7, 2019

(65) Prior Publication Data

US 2021/0100407 A1 Apr. 8, 2021

(51) Int. Cl.

| | |
|---|---|
| ***A47K 7/04*** | (2006.01) |
| ***B08B 1/00*** | (2006.01) |
| ***B08B 3/08*** | (2006.01) |
| ***B08B 1/04*** | (2006.01) |

(52) U.S. Cl.

CPC ..... *A47K 7/04* (2013.01); *B08B 1/002* (2013.01); *B08B 1/04* (2013.01); *B08B 3/08* (2013.01)

(58) Field of Classification Search
None
See application file for complete search history.

(56) References Cited

U.S. PATENT DOCUMENTS

| | | | | |
|---|---|---|---|---|
| 6,032,313 | A * | 3/2000 | Tsang | A47L 11/4038 451/259 |
| 7,320,691 | B2 * | 1/2008 | Pilcher | A61B 17/54 604/289 |
| 8,641,702 | B2 * | 2/2014 | Pilcher | A46B 15/0002 606/9 |
| 9,038,224 | B1 | 5/2015 | Esquibel | |
| 9,788,693 | B1 | 10/2017 | Zhou | |
| 10,194,742 | B2 * | 2/2019 | Meginniss, III | A46B 5/0012 |
| 2010/0064463 | A1 | 3/2010 | Beatty et al. | |
| 2012/0165710 | A1 | 6/2012 | Nichols | |

(Continued)

FOREIGN PATENT DOCUMENTS

| | | |
|---|---|---|
| CN | 2100132 U | 4/1992 |
| CN | 101150976 A | 3/2008 |

(Continued)

*Primary Examiner* — Joseph J Hail
*Assistant Examiner* — Dana Lee Poon
(74) *Attorney, Agent, or Firm* — Birch, Stewart, Kolasch & Birch, LLP

(57) ABSTRACT

A cleansing device is proposed. The cleansing device may include an inner cleansing part coming into close contact with a cleansing target; an outer cleansing part provided outside the inner cleansing part; and a rotating part configured to rotate the inner cleansing part and the outer cleansing part relative to each other. The inner cleansing part and the outer cleansing part have at least one contact point.

10 Claims, 5 Drawing Sheets

(56) References Cited

U.S. PATENT DOCUMENTS

| | | | | |
|---|---|---|---|---|
| 2015/0182078 | A1* | 7/2015 | Miller | A46B 13/008 15/22.1 |
| 2016/0045081 | A1* | 2/2016 | Kern | A46B 13/008 15/22.4 |
| 2016/0235257 | A1* | 8/2016 | Daffer | A47K 7/04 |
| 2017/0150851 | A1 | 6/2017 | Sueyoshi et al. | |
| 2017/0202732 | A1* | 7/2017 | Nichols | A61H 23/02 |
| 2019/0029411 | A1* | 1/2019 | Brewer | A61C 17/221 |

FOREIGN PATENT DOCUMENTS

| | | | |
|---|---|---|---|
| CN | 101193605 | A | 6/2008 |
| CN | 102202601 | A | 9/2011 |
| CN | 203354429 | U | 12/2013 |
| CN | 103717727 | A | 4/2014 |
| CN | 203913857 | U | 11/2014 |
| CN | 104320992 | A | 1/2015 |
| CN | 105377097 | A | 3/2016 |
| CN | 205162923 | U | 4/2016 |
| CN | 105595892 | A | 5/2016 |
| CN | 106667342 | A | 5/2017 |
| CN | 206491736 | U | 9/2017 |
| CN | 107635433 | A | 1/2018 |
| EP | 1 997 566 | A1 | 12/2008 |
| JP | 55-7974 | U | 1/1980 |
| JP | 2002-320580 | A | 11/2002 |
| JP | 2003-39143 | A | 2/2003 |
| JP | 2003-299704 | A | 10/2003 |
| JP | 3157808 | U | 3/2010 |
| JP | 2010-246868 | A | 11/2010 |
| JP | 2015-198731 | A | 11/2015 |
| JP | 2016-500522 | A | 1/2016 |
| KR | 10-0656887 | B1 | 12/2006 |
| KR | 10-1257256 | B1 | 5/2013 |
| KR | 20-0471793 | Y1 | 3/2014 |
| KR | 10-1385515 | B1 | 4/2014 |
| KR | 10-1385516 | B1 | 4/2014 |
| KR | 10-1406077 | B1 | 6/2014 |
| KR | 10-2016-0017540 | A | 2/2016 |
| KR | 10-2017-0075255 | A | 7/2017 |
| KR | 10-1862975 | B1 | 5/2018 |
| WO | WO 00/65971 | A1 | 11/2000 |
| WO | WO 2013/132363 | A1 | 9/2013 |

* cited by examiner

CLEANSING DEVICE

CROSS REFERENCE TO RELATED APPLICATIONS

This application is the National Phase of PCT International Application No. PCT/KR2018/005152, filed on May 3, 2018, which is hereby expressly incorporated by reference into the present application.

TECHNICAL FIELD

The present disclosure relates to a cleansing device. More particularly, the present disclosure relates to a cleansing device configured such that inner and outer cleansing parts are rotated in different directions, and the inner and outer cleansing parts have one or more contact points, thus increasing bubble generating force and thereby realizing efficient cleaning.

BACKGROUND ART

Generally, everyone has a desire for the beauty of a body regardless of gender or age. In order to pursue the beauty of skin that is first recognized by others, among the beauty of the body, people perform skin care using various means and methods.

The skin care aims to keep skin clean and smooth without blemishes. Particularly, people are most interested in performing the skin care of the face among body parts. Therefore, people continuously make efforts to keep the skin clean by massaging the face for the purpose of skin care, applying functional cosmetics for making skin beautiful, or using various kinds of cleansing products.

Among them, the importance of washing the face is gradually increasing to eliminate wastes from the skin. In order to wash the face, people use a method of applying a cleansing product such as a liquid cleansing formulation to the face and then washing the cleansing product out.

However, in the case of washing the face using the hand, the cleansing product may not be evenly transmitted to the skin, and bacterial infection may be caused by the hand. Recently, a method of indirectly applying the cleansing product to the skin using various tools is used. Particularly, a face washing method using a device that includes a brush among tools and causes vibration or generates rotation is widely used.

An existing brush device adopts a method in which the brush is rotated only in one direction or is vibrated to perform a cleansing operation according to a user's motion. This transmits asymmetrical force to the face having a symmetrical muscle arrangement.

Furthermore, this is problematic in that various types of stimulation may not be applied to the skin. Particularly, a product rotated in one direction or a product operated by strong vibration may cause a phenomenon in which the cleansing product is splashed out, thus causing inconvenience to a user, and a cleansing product may enter a sensitive part such as an eye, thus causing a serious problem.

Furthermore, a commercially-available cleansing device has cleansing power but a cleansing product may be caught by the brush, so that bubbles may not be generated. In this case, since consumers themselves should make bubbles with the hands and apply the bubbles to the brush, it is inconvenient to use. There is a problem that residues of the cleansing product remain even when cleansing later.

In order to increase the bubble generating force of the cleansing product, a separate device should be purchased, and financial burdens associated with the consumer's purchase are increased. An existing method where a consumer makes bubbles with his or her hands is low in bubble generating effect. Complicated methods where a bubble generating device makes an air passage and a detergent connection passage to generate bubbles and requires a nozzle for moving the generated bubbles are being used. As an existing method of generating bubbles, a method of mixing air and cleansing solution through a cleansing net is used. However, this method has drawbacks in that it is difficult to generate bubbles containing delicate or homogeneous air, and air bubbles may be easily lost.

DISCLOSURE

Technical Problem

The present disclosure has been made to solve the above-mentioned problems and difficulties, and an object of the present disclosure is to provide a cleansing device that increases the force of mixing a cleansing product, air, and water without coming into contact with a hand or a face, thus increasing a bubble generating force.

Another object of the present disclosure is to provide a cleansing device that prevents generated bubbles from being splashed out when in use, thus preventing the waste of a cleansing product and improving a user's satisfaction.

Technical Solution

A cleansing device in accordance with an embodiment of the present disclosure includes a cleansing device, including an inner cleansing part coming into close contact with a cleansing target; an outer cleansing part provided outside the inner cleansing part; and a rotating part configured to rotate the inner cleansing part and the outer cleansing part relative to each other, wherein the inner cleansing part and the outer cleansing part may have at least one contact point.

The inner cleansing part and the outer cleansing part may be rotated in different directions.

The contact point may be at least one portion where the inner cleansing part and the outer cleansing part come into contact with each other, and force for mixing a cleansing product, air, and water may be increased by rotational friction while the inner cleansing part and the outer cleansing part are rotated, thus generating a bubble.

The inner cleansing part and the outer cleansing part may have at least one receptor.

The receptor may be a space where the inner cleansing part and the outer cleansing part do not come into contact with each other, and may receive the bubble generated in the contact point, thus providing the bubble to an upper surface of the inner cleansing part.

The inner cleansing part may be made of a mesh or sponge material, and at least one protrusion may be provided on a side of the inner cleansing part such that at least a portion thereof overlaps the outer cleansing part.

An end of the protrusion may be cut.

The inner cleansing part may be formed in a flat structure in which an upper surface thereof has a height equal or similar to that of the outer cleansing part.

The inner cleansing part may be formed in a tilt structure where the upper surface thereof is tilted to one direction such that a height of a first side of the inner cleansing part is equal or similar to that of the outer cleansing part and a height of a second side thereof is lower than that of the outer cleansing part.

The inner cleansing part may be formed in an edge cutting structure having a cut portion that is vertically or horizontally formed in a side surface of the inner cleansing part by cutting.

The inner cleansing part may be formed in a structure in which the tilt structure where the upper surface thereof is tilted to one direction and the edge cutting structure having the cut portion that is vertically or horizontally formed in the side surface thereof by cutting are combined with each other.

The inner cleansing part may be formed in a structure in which the flat structure in which the upper surface thereof has a height equal or similar to that of the outer cleansing part and the edge cutting structure having the cut portion that is vertically or horizontally formed in the side surface thereof by cutting are combined with each other.

The outer cleansing part may be composed of a brush having a plurality of hairs, and a height of the outer cleansing part may be equal to or higher than that of the inner cleansing part and the hairs of the brush may be compactly arranged to prevent the bubble generated by friction with the inner cleansing part from being splashed out.

Advantageous Effects

A cleansing device in accordance with the present disclosure is configured such that that inner and outer cleansing parts are rotated in different directions or rotated relative to each other, and the inner and outer cleansing parts have one or more contact points, thus increasing the force of mixing a cleansing product, air, and water by the friction of the inner and outer cleansing parts in a contact point, increasing a bubble generating force, and thereby realizing efficient cleaning.

Furthermore, a cleansing device in accordance with the present disclosure is advantageous in that it can minimize irritation to a user's skin due to an increase in bubble generating force, thus improving a user's satisfaction for products.

Furthermore, a cleansing device in accordance with the present disclosure is advantageous in that an outer cleansing part is made of a material compactly surrounding an inner cleansing part, thus preventing bubbles generated therein from being splashed out when in use, and thereby preventing the waste of a cleansing product and improving a user's satisfaction.

MODE FOR INVENTION

Figure 1:
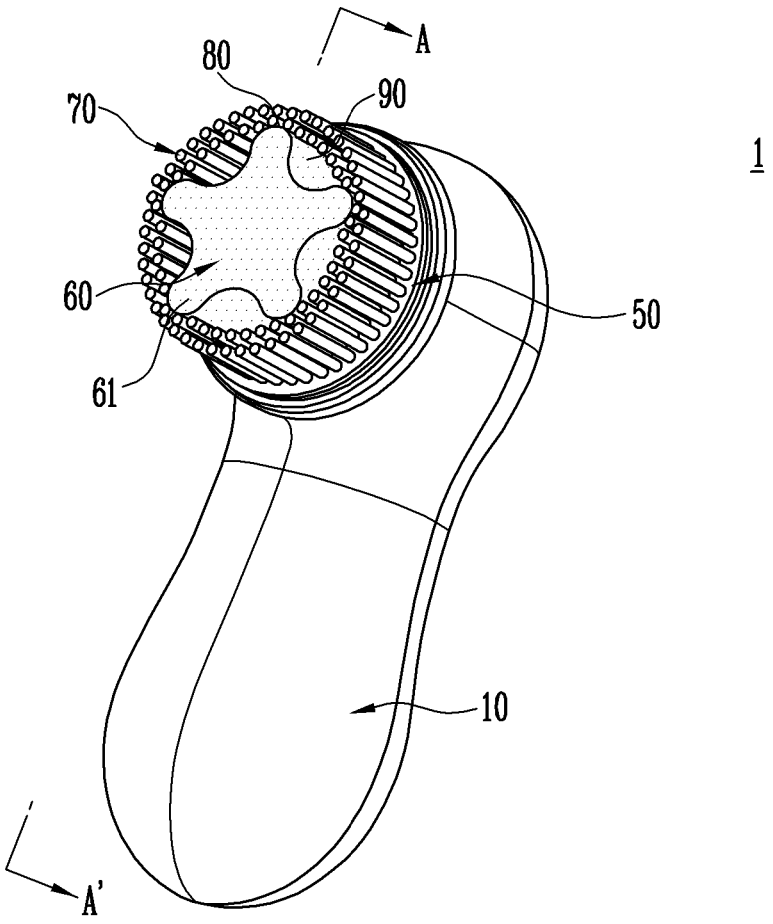
FIG. 1 is a perspective view illustrating a cleansing device in accordance with an embodiment of the present disclosure.

The above and other objects, features, and other advantages of the present disclosure will be more clearly understood from the following detailed description when taken in conjunction with the accompanying drawings. In the present specification, it should be noted that the same reference numerals are used to denote the same components throughout different drawings. In the following description, the detailed description of known functions and configurations that may unnecessarily obscure the subject matter of the present disclosure will be omitted.

Hereinafter, preferred embodiments of the present disclosure will be described in detail with reference to the accompanying drawings.

Figure 2:
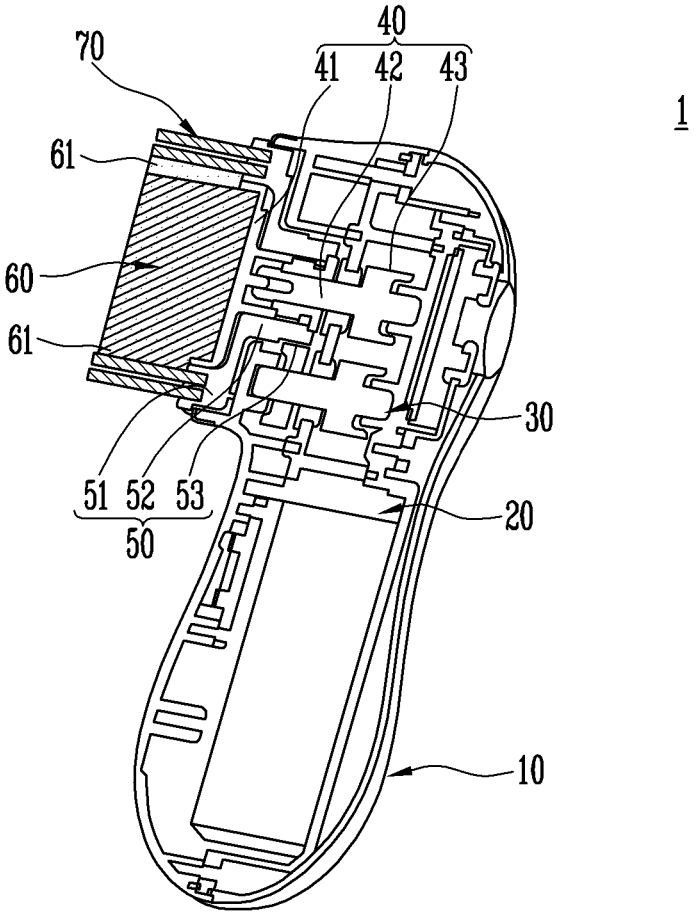
FIG. 2 is a sectional view taken along line A-A' of FIG. 1.
Figure 3:
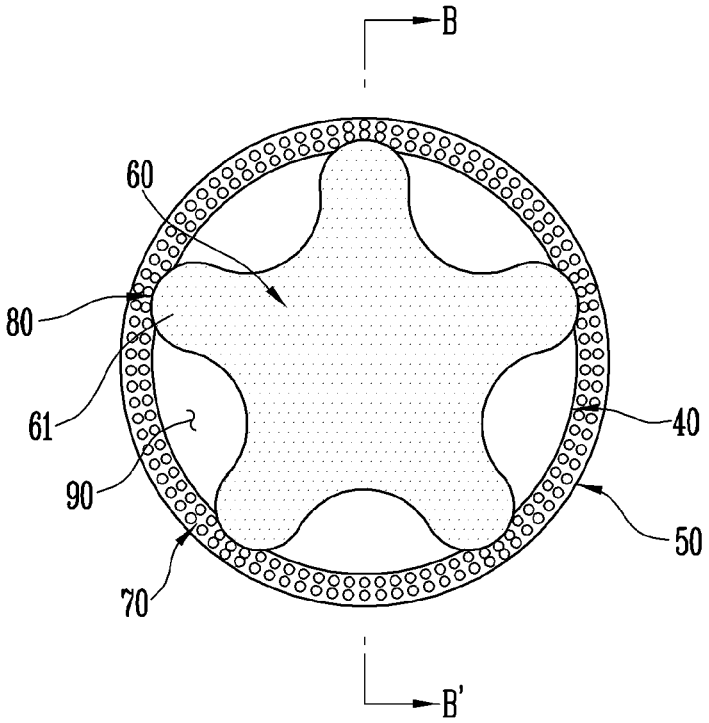
FIG. 3 is a plan view of inner and outer cleansing parts in the cleansing device in accordance with an embodiment of the present disclosure.
Figure 4:
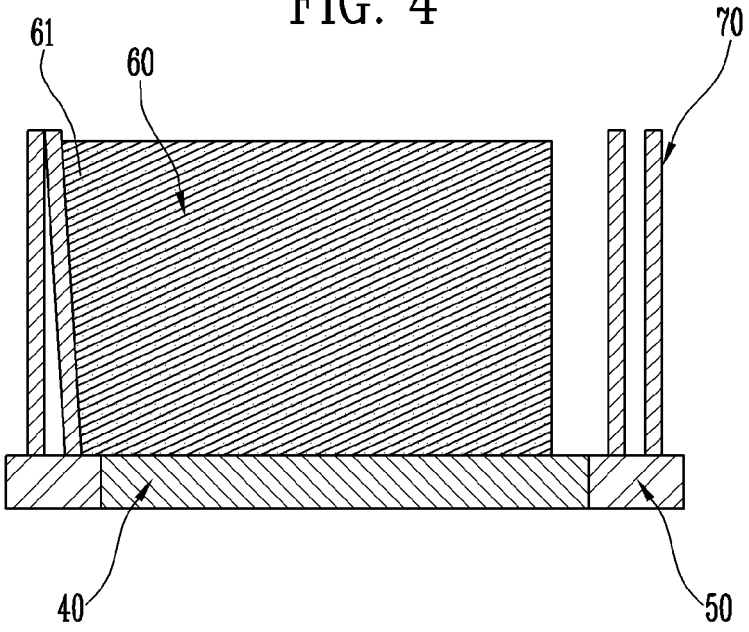
FIG. 4 is a sectional view taken along line B-B' of FIG. 3 for explaining a structure of an inner cleansing part in the cleansing device in accordance with an embodiment of the present disclosure.
Figure 5:
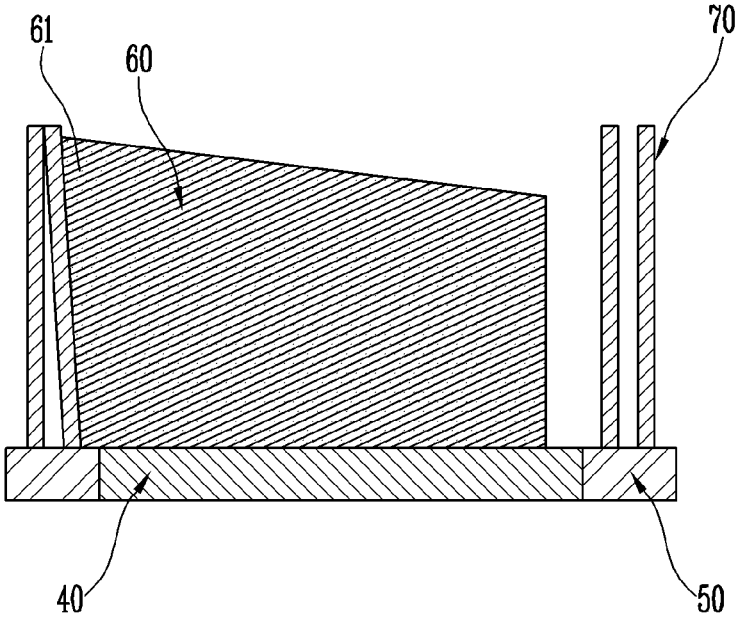
FIG. 5 is a sectional view taken along line B-B' of FIG. 3 for explaining another structure of the inner cleansing part in the cleansing device in accordance with an embodiment of the present disclosure.
Figure 6:
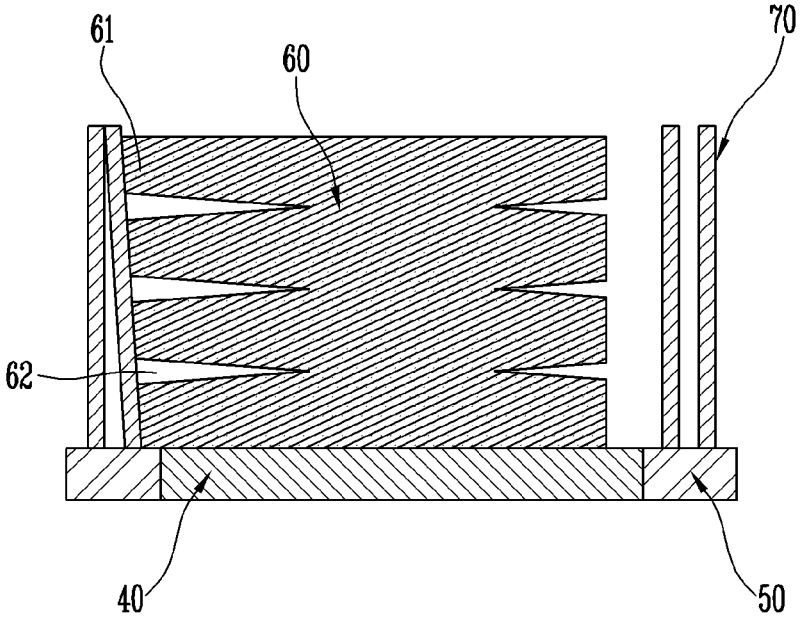
FIG. 6 is a sectional view taken along line B-B' of FIG. 3 for explaining yet another structure of the inner cleansing part in the cleansing device in accordance with an embodiment of the present disclosure.
Figure 7:
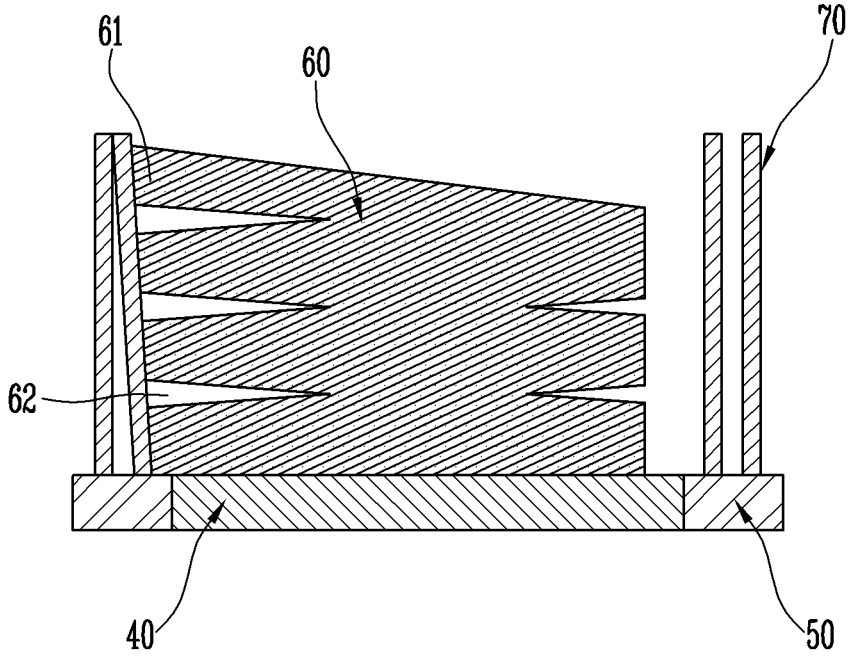
FIG. 7 is a sectional view taken along line B-B' of FIG. 3 for explaining a further structure of the inner cleansing part in the cleansing device in accordance with an embodiment of the present disclosure.

FIG. 1 is a perspective view illustrating a cleansing device in accordance with an embodiment of the present disclosure, FIG. 2 is a sectional view taken along line A-A' of FIG. 1, FIG. 3 is a plan view of inner and outer cleansing parts in the cleansing device in accordance with an embodiment of the present disclosure, FIG. 4 is a sectional view taken along line B-B' of FIG. 3 for explaining a structure of an inner cleansing part in the cleansing device in accordance with an embodiment of the present disclosure, FIG. 5 is a sectional view taken along line B-B' of FIG. 3 for explaining another structure of the inner cleansing part in the cleansing device in accordance with an embodiment of the present disclosure, FIG. 6 is a sectional view taken along line B-B' of FIG. 3 for explaining yet another structure of the inner cleansing part in the cleansing device in accordance with an embodiment of the present disclosure, and FIG. 7 is a sectional view taken along line B-B' of FIG. 3 for explaining a further structure of the inner cleansing part in the cleansing device in accordance with an embodiment of the present disclosure.

Referring to FIGS. 1 to 3, a cleansing device 1 in accordance with an embodiment of the present disclosure is a device that comes into contact with skin to cleanse the skin or applies certain stimulation to skin to massage the skin, and includes a case 10, a drive source 20, a power transmission part 30, an inner rotating part 40, an outer rotating part 50, an inner cleansing part 60, and an outer cleansing part 70.

In this regard, the skin described in the present disclosure may mean all of a face, a body, and a scalp. Furthermore, for convenience, the cleansing device 1 of the present disclosure will be described using a device for skin care as an example. However, without being limited thereto, this cleansing device may be applied to a cleaning device.

The case 10 may include therein the drive source 20 that will be described below, the power transmission part that will be described below, and the inner and outer rotating parts 40 and 50 that will be described below. The inner and outer cleansing parts 60 and 70 that will be described below may be provided on a side of the case.

The case 10 may have the shape of a curved surface to increase a user's convenience, and may be provided with at least one finger seat (not shown) to stably place a user's finger holding the case 10 thereon. In other words, a user may perform a cleansing operation by making the inner and outer cleansing parts 60 and 70, which will be described below, come into close contact with the skin with the user holding the case 10.

The drive source 20 may be provided in the case 10, and may generate power to impart rotating force to the inner and outer rotating parts 40 and 50 on which the inner and outer cleansing parts 60 and 70 are provided, through the power transmission part 30 that will be described below.

The drive source 20 may be a rotary motor, or a servomotor for rotating at a predetermined angle the inner and outer rotating parts 40 and 50 on which the inner and outer cleansing parts 60 and 70 are provided.

The power transmission part 30 may be provided in the case 10, and may be installed between the drive source 20 and the inner and outer rotating parts 40 and 50 to transmit the power of the drive source 20 to the inner and outer rotating parts 40 and 50 that will be described below, thus rotating the inner rotating part 40 and the outer rotating part 50 in opposite directions. That is, the power transmission part 30 may be configured to rotate the inner cleansing part 60 and the outer cleansing part 70 in different directions.

Furthermore, the power transmission part 30 may be configured to transmit power to either of the inner rotating part 40 or the outer rotating part 50, and to rotate the inner rotating part or the outer rotating part relative to the inner rotating part 40 or the outer rotating part 50 to which power is not transmitted.

The inner rotating part 40 may be connected to the power transmission part 30 to rotate the inner cleansing part 60 that will be described below.

The inner rotating part 40 may receive the power of the drive source 20 through the power transmission part 30 to be rotated clockwise and/or counterclockwise, and may rotate with the inner cleansing part 60 that will be described below being fixed, thus rotating the inner cleansing part 60.

Such an inner rotating part 40 may include an inner rotating plate 41, an inner rotating shaft 42, and an inner rotating body 43.

The inner rotating plate 41 may fix the inner cleansing part 60 that will be described below.

The inner rotating plate 41 may be provided in the shape of a disc, and the inner rotating shaft 42 may be provided on a surface opposite to a surface on which the inner cleansing part 60 is provided. Here, the inner rotating plate 41 and the inner rotating shaft 42 may be integrally provided, or be separately provided and then assembled with each other.

The inner rotating shaft 42 may form the rotation center of the inner rotating plate 41. The inner rotating shaft 42 may be provided on the center of the inner rotating plate 41. Of course, the inner rotating shaft 42 may be offset from the center of the inner rotating plate 41. In this case, the outer rotating part 50 that will be described below may have a space formed by the inner rotating plate 41 that is rotated by the offset inner rotating shaft 42, thus preventing the inner rotating plate 41 from colliding with the outer rotating plate 51.

The thickness of the inner rotating shaft 42 may be variously determined according to the weight or rotating speed of the inner rotating plate 41, and the inner rotating shaft 42 may be located inside an outer rotating shaft 52 that will be described below. In other words, when the interior of the outer rotating shaft 52 is empty, the inner rotating shaft 42 may be provided to rotate inside the outer rotating shaft 52.

A first end of the inner rotating shaft 42 may be fixed to the inner rotating plate 41, while a second end thereof may be fixed to the inner rotating body 43. Of course, since the inner rotating body 43 may be directly fixed to a surface of the inner rotating plate 41, the inner rotating shaft 42 may be omitted.

The inner rotating body 43 may be provided on the inner rotating shaft 42. The inner rotating body 43 may engage with the power transmission part 30 to rotate clockwise and/or counterclockwise, and may have various shapes, such as a gear having gear teeth or a roller rotated using surface frictional force.

The outer rotating part 50 may be connected to the power transmission part 30 to rotate the outer cleansing part 70 that will be described below.

Similarly to the inner rotating part 40, the outer rotating part 50 may receive the power of the drive source 20 through the power transmission part 30, may be rotated in an opposite direction to that of the inner rotating part 40, and may rotate with the outer cleansing part 70 that will be described below being fixed, thus rotating the outer cleansing part 70.

Such an outer rotating part 50 may include an outer rotating plate 51, an outer rotating shaft 52, and an outer rotating body 53.

The outer rotating plate 51 may fix the outer cleansing part 70 that will be described below.

The outer rotating plate 51 may be provided to surround the inner rotating plate 41, and may have a ring shape instead of a disc shape. Here, an inner hole of the ring may be equal to or slightly larger than a diameter of the inner rotating plate 41.

However, when the inner rotating shaft 42 is connected to a position that deviates from the center of the inner rotating plate 41, the inner hole of the outer rotating plate 51 may be formed to a size that is suitable for preventing the collision of the inner rotating plate 41 that is rotated by the inner rotating shaft 42.

The outer rotating plate 51 has a ring shape, and may be configured such that a surface to which the outer cleansing part 70 is fixed is on the same plane as a surface of the inner rotating plate 41 to which the inner cleansing part 60 is fixed. Of course, according to this embodiment, the surface of the outer rotating plate 51 may be offset from the surface of the inner rotating plate 41.

Although the surface of the outer rotating plate 51 is offset from the surface of the inner rotating plate 41, the surface of the outer rotating plate 51 may be parallel to the surface of the inner rotating plate 41.

The outer rotating shaft 52 may form the rotation center of the outer rotating plate 51. In this case, the outer rotating shaft 52 may be formed in a hollow shape, so that the inner rotating shaft 42 may be provided in the outer rotating shaft. Therefore, the outer rotating shaft 52 may have a diameter that is sufficiently larger than that of the inner rotating shaft 42.

The outer rotating body 53 may be provided on the outer rotating shaft 52. The outer rotating body 53 may engage with the power transmission part 30 to rotate in an opposite direction to that of the inner rotating body 43. Similarly to the inner rotating body 43, the outer rotating body may have various shapes, such as a gear having gear teeth or a roller rotated using surface frictional force.

Although it has been described that the inner rotating part 40 and the outer rotating part 50 are rotated in different directions by power transmitted from the power transmission part 30, only the inner rotating part 40 may be rotated and the outer rotating part 50 may be rotated relative to the inner rotating part, or only the outer rotating part 50 may be rotated and the inner rotating part 40 may be rotated relative to the outer rotating part.

In other words, the inner rotating part 40 and the outer rotating part 50 may rotate the inner cleansing part 60 and the outer cleansing part 70, which will be described below, relative to each other.

The inner cleansing part 60 and the outer cleansing part 70 may be configured to have a function of generating bubbles as well as a characteristic function of cleansing or massaging skin by coming into close contact with a cleansing target. Here, expression "the cleansing target" may mean human skin as described above, or a floor requiring cleaning.

The inner cleansing part 60 and the outer cleansing part 70 may be rotated in different directions or relative to each other so as to increase the bubble generating force, and may be configured to have one or more contact points 80 and one or more receptors 90.

The contact points 80 are one or more portions where the inner cleansing part 60 and the outer cleansing part 70 come into contact with each other, and may generate bubbles by increasing the force of mixing a cleansing product, air, and water by rotational friction while the inner cleansing part 60 and the outer cleansing part 70 rotate in different directions or rotate relative to each other.

Each receptor 90 is a space where the inner cleansing part 60 and the outer cleansing part 70 do not come into contact with each other, and receives bubbles generated in the contact point 80, thus providing the bubbles to an upper surface of the inner cleansing part 60.

For example, the inner cleansing part 60 and the outer cleansing part 70 may overlap each other by at most −0.5 cm in the contact point 80, and the inner cleansing part 60 and the outer cleansing part 70 may be spaced apart from each other by at most 0.5 cm in the receptor 90. That is, a distance between the inner cleansing part 60 and the outer cleansing part 70 may range from −0.5 cm to 0.5 cm.

The shape of each of the inner cleansing part 60 and the outer cleansing part 70 will be described in detail.

The inner cleansing part 60 may be provided on the inner rotating plate 41 of the inner rotating part 40 to rotate clockwise and/or counterclockwise, and may be made of a material such as mesh or sponge.

The inner cleansing part 60 may be surrounded by the outer cleansing part 70, and one or more protrusions 61 may be provided on a side of the inner cleansing part such that at least a portion of each protrusion overlaps the outer cleansing part 70. In other words, when the outer cleansing part 70 has a ring shape, the inner cleansing part 60 may not be made in a shape corresponding to a ring shape, such as a star shape, a flower shaper, or a polygonal shape, but may be made in a curved shape that at least partially protrudes outwards. A protruding portion becomes the protrusion 61 overlapping the outer cleansing part 70. Here, a portion where the protrusion 61 formed on the inner cleansing part 60 and the outer cleansing part 70 come into contact with each other becomes the contact point 80.

The inner cleansing part 60 having the protrusion 61 may have an uneven structure in which its upper surface coming into close contact with the cleansing target causes friction, or may be a structure having a material that easily causes friction. In other words, the shape or the structure of the upper surface of the inner cleansing part 60 coming into close contact with the cleansing target is not particularly limited, and all shapes capable of cleansing are possible.

Furthermore, the inner cleansing part 60 having the protrusion 61 may be formed in a flat structure in which its upper surface has a height equal or similar to that of the outer cleansing part 70 as illustrated in FIG. 4, but may be formed in various structures that may further increase the degree of bubbles covering the inner cleansing part 60 as compared with the flat structure, as illustrated in FIGS. 5 to 7. This will be described below.

Referring to FIG. 5, the inner cleansing part 60 may be formed in a tilt structure in which its upper surface is tilted to a direction. Since a height of a first side of the inner cleansing part 60 formed in the tilt structure is equal or similar to that of the outer cleansing part 70 and a height of a second side thereof is lower than that of the outer cleansing part 70, a space is created above the inner cleansing part 60. Thus, while the inner cleansing part 60 and the outer cleansing part 70 rotate in different directions or rotate relative to each other, bubbles that are continuously generated in the contact point 80 rise to the upper surface of the inner cleansing part 60 rather than escaping through the outer cleansing part 70 to the outside, thus resulting in increasing the amount of the bubbles that cover the inner cleansing part 60.

However, this embodiment embraces a case where the tilt structure is applied to at least a portion of the upper surface. In other words, the upper surface of the inner cleansing part 60 may be a shape in which the flat structure and the tilt structure are combined with each other. For example, a central portion of the inner cleansing part may have a flat structure, and a peripheral portion thereof may have a tilt structure. However, the present disclosure is not limited thereto.

Referring to FIG. 6, the inner cleansing part 60 may be formed in an edge cutting structure having a cut portion 62 that is vertically or horizontally formed in a side surface of the inner cleansing part by cutting. Such an edge cutting structure may be configured to combine with the above-described flat structure. The inner cleansing part 60 formed in the edge cutting structure generates bubbles in the contact point 80 while the inner cleansing part 60 and the outer cleansing part 70 rotate in different directions or rotate relative to each other, and in addition, further increases the force of mixing the cleansing product, the air, and the water in the cut portion 62, thus further increasing the bubble generating force and thereby increasing the amount of the bubbles that cover the inner cleansing part 60.

Referring to FIG. 7, the inner cleansing part 60 may be formed in a structure in which the tilt structure and the edge cutting structure are combined with each other. As described above, the inner cleansing part 60 formed in the combined structure may further increase the amount of bubbles that cover the inner cleansing part 60.

Of course, the edge cutting structure may be formed on the inner cleansing part 60 having the upper surface in which the flat structure and the tilt structure are combined with each other.

The outer cleansing part 70 may be provided on the outer rotating plate 51 of the outer rotating part 50 to surround the inner cleansing part 60, so that the outer cleansing part may be rotated in a direction different from that of the inner cleansing part 60 or rotated relative to the inner cleansing part. The outer cleansing part may be composed of a brush having a plurality of hairs.

The outer cleansing part 70 may be configured to prevent bubbles generated by friction with the inner cleansing part 60 from being splashed out. To this end, the height of the outer cleansing part 70 may be equal to or higher than that of the inner cleansing part 60. The outer cleansing part may be formed such that the hairs of the brush are compactly arranged to reduce the splashing of the bubbles to the surrounding environment, due to the characteristics of the bubbles containing air.

The outer cleansing part 70 may not have the shape of a plurality of hairs but may be various applicators each having a round shape or a projection shape.

Here, the hairs forming the outer cleansing part 70 may be made of various materials, for example, plastics such as polyurethane, polyethylene, polyester, polyether, polypropylene, polystyrene, ABS, SAN, acryl, polyamide, polycarbonate, polyethylene terephthalate, or nylon, silicon, ceramics, rubber, natural fiber, synthetic fibers or metal fibers.

This embodiment is configured such that the inner cleansing part 60 and the outer cleansing part 70 are rotated in different directions or rotated relative to each other, and the inner and outer cleansing parts 60 and 70 have one or more contact points 80. Thus, by the friction of the inner and outer cleansing parts 60 and 70 in the contact points 80, the force of mixing the cleansing product, air, and water may be increased and thereby the bubble generating force may be increased. Consequently, efficient cleaning can be realized.

Furthermore, according to this embodiment, it is possible to minimize irritation to a user's skin due to an increase in bubble generating force, thus improving a user's satisfaction for products.

Furthermore, according to this embodiment, the outer cleansing part 70 is made of a material that compactly surrounds the inner cleansing part 60, thus preventing bubbles generated therein from being splashed out when in use, and thereby preventing the waste of the cleansing product and improving a user's satisfaction.

Figure 8:
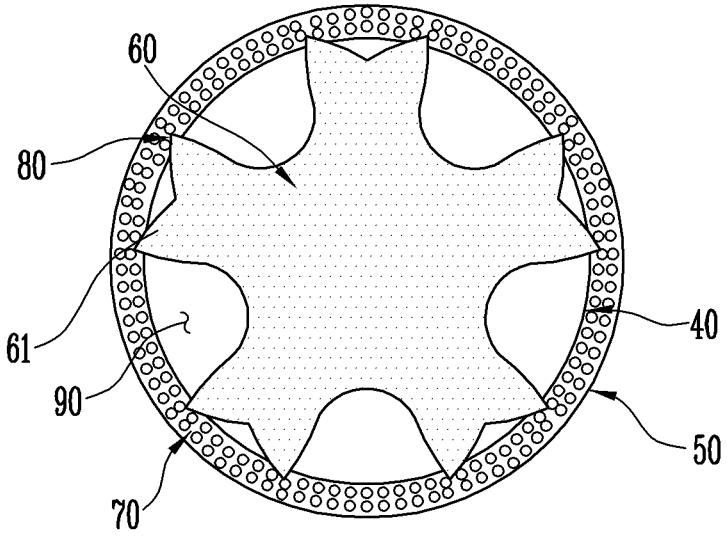
FIG. 8 is a plan view of inner and outer cleansing parts in a cleansing device in accordance with another embodiment of the present disclosure.

FIG. 8 is a plan view of inner and outer cleansing parts in a cleansing device in accordance with another embodiment of the present disclosure.

Referring to FIG. 8, unlike the above-mentioned embodiment, an end of the protrusion 61 may be cut inwards. For example, when viewed from a plane, the inner cleansing part 60 may be formed in a concavely cut shape, such as a 'V' shape.

In this case, the number of contact points 80 between the inner cleansing part 60 and the outer cleansing part 70 according to this embodiment may be greater than that of the preceding embodiment, thus further increasing the bubble generating force in the contact points 80. The description of components common to both embodiments will be omitted herein.

Although the present disclosure was described with reference to specific embodiments, it is apparent to those skilled in the art that the present disclosure may be changed and modified in various ways without departing from the scope of the present disclosure, which is described in the following claims. Therefore, it should be interpreted that modifications or changes that can be easily derived from the embodiments of the present disclosure fall within the purview of the present disclosure.

The invention claimed is:

1. A cleansing device, comprising:

an inner cleansing part coming into close contact with a cleansing target;

an outer cleansing part provided outside the inner cleansing part; and a rotating part configured to rotate the inner cleansing part and the outer cleansing part relative to each other, wherein the inner cleansing part has a shape in which a distance from a circumference thereof to the outer cleansing part varies such that at least one protrusion and at least one receptor are formed, wherein, when the cleansing device is operated, the at least one protrusion overlaps the outer cleansing part to generate a bubble by rotational friction and transmits the bubble to the at least one receptor, and wherein the at least one receptor is provided to be opened in a direction parallel to a rotation center of the rotating part and, when the cleansing device is operated, the at least one receptor continuously moves in a direction of rotation of the inner cleansing part and is configured to transmit the bubble received therein to the cleansing target when exposed surfaces of the inner cleansing part and the outer cleansing part come into contact with the cleansing target.

2. The cleansing device of claim 1, wherein the inner cleansing part and the outer cleansing part are rotated in different directions.

3. The cleansing device of claim 1, wherein the inner cleansing part is made of a mesh or sponge material.

4. The cleansing device of claim 3, wherein an end of the at least one protrusion is cut.

5. The cleansing device of claim 1, wherein the inner cleansing part is formed in a flat structure in which an upper surface thereof has a height equal or similar to that of the outer cleansing part.

6. The cleansing device of claim 1, wherein the inner cleansing part is formed in a tilt structure where an upper surface thereof is tilted to one direction such that a height of a first side of the inner cleansing part is equal or similar to that of the outer cleansing part and a height of a second side thereof is lower than that of the outer cleansing part.

7. The cleansing device of claim 1, wherein the inner cleansing part is formed in an edge cutting structure having a cut portion that is vertically or horizontally formed in a side surface of the inner cleansing part by cutting.

8. The cleansing device of claim 1, wherein the inner cleansing part is formed in a structure in which a tilt structure where an upper surface thereof is tilted to one direction and an edge cutting structure having a cut portion that is vertically or horizontally formed in a side surface thereof by cutting are combined with each other.

9. The cleansing device of claim 1, wherein the inner cleansing part is formed in a structure in which a flat structure in which an upper surface thereof has a height equal or similar to that of the outer cleansing part and an edge cutting structure having a cut portion that is vertically or horizontally formed in a side surface thereof by cutting are combined with each other.

10. The cleansing device of claim 1, wherein the outer cleansing part is composed of a brush having a plurality of hairs, and a height of the outer cleansing part is equal to or higher than that of the inner cleansing part and the hairs of the brush are compactly arranged to prevent the bubble generated by friction with the inner cleansing part from being splashed out.

* * * * *